US005426999A

United States Patent [19]

Seiler et al.

[11] Patent Number: 5,426,999

[45] Date of Patent: Jun. 27, 1995

[54] SHARPENING GUIDE FOR HAND INSTRUMENTS AND TOOLS

[76] Inventors: Victoria Seiler; Dave L. Goodwin, both of 3713 NW. 107 Ter., Gainesville, Fla. 32606

[21] Appl. No.: 297,138

[22] Filed: Aug. 29, 1994

[51] Int. Cl.[6] ..... B24B 3/00

[52] U.S. Cl. ..... 76/82; 451/369; 451/410

[58] Field of Search ..... 76/82, 88, 82.2; 451/406, 407, 409, 369, 410; 433/166, 125, 142

[56] References Cited

U.S. PATENT DOCUMENTS

| | | | |
|---|---|---|---|
| 483,042 | 9/1892 | Brown | 451/406 |
| 1,675,981 | 7/1928 | Lees | 451/369 |
| 2,287,910 | 6/1942 | Slack | 451/369 |
| 2,324,025 | 7/1943 | Revell | 451/369 |
| 4,821,462 | 4/1989 | Moore | 76/88 |

*Primary Examiner*—Douglas D. Watts

[57] ABSTRACT

A sharpener is disclosed which consists of a platform with formed grooves to accommodate instrument handles at specific angles to direct the blade of the instrument to a sharpening stone which slides in a groove on the platform. The sharpener will be sterilizable to prevent cross contamination.

5 Claims, 1 Drawing Sheet

SHARPENING GUIDE FOR HAND INSTRUMENTS AND TOOLS

BACKGROUND—FIELD OF INVENTION

This invention relates to hand sharpening instruments and tools with a specific application for dental instruments illustrated.

BACKGROUND—DESCRIPTION OF PRIOR ART

Dental instruments, specifically hand instruments with a cutting edge, require regular sharpening in a very standardized fashion to maintain this cutting edge. A stone is applied to the cutting edge and uniform, repetitive strokes are required to hone this edge. Each time a deviation is made, the cutting edge is altered and it is more difficult to reproduce and edge through sharpening. The result is premature wearing and a short life of the instrument.

For this process to be successful, each element must be standardized in position, the instrument and the stone. Current methodology does not stabilize both elements for a successful result.

The first current method is hand sharpening, relying on visual examination of the product, resulting in poor uniformity. The stone and the instrument are held in subjective positions and the cutting edge os stroked with the stone. The positions vary with each application, as human hand-eye coordination cannot be standardized with machine-like precision.

The second current method is machine sharpening, an example of a product is the RX (registered) Honer. The instrument is placed against a guide and applied to an oscillating stone which strokes against the hand held instrument. The stone position is stabilized, but the instrument position is subjective.

The third current method is the use of a guide for the instrument position with a stabilized flat stone. A manufactured patent pending example is the DISC sharpener by Moore. In this example, the stone is stabilized, and a visual guide is provided for the instrument position. This leaves placement of the instrument to subjective coordination with he guide.

In each of the examples, the method does not standardize both elements, the stone and the instrument position. Each time the stone is applied to the blade, it will have a different position and alter the cutting edge due to the subjective nature of the placement.

Current methods have one other disadvantage, the device cannot be completely sterilized. This allows for cross contamination between patients unless the instruments are all completely sterile when the device is used. This is a major disadvantage in this era of dangerous communicable disease.

A device for sharpening effectively should contain the elements of stabilization of the instrument and stone for a uniform result and the ability to be sterilized to prevent cross contamination of communicable disease.

OBJECTS AND ADVANTAGES

This sharpening device will have advantages not available in current art:

(a) standardized position for the stone against the instrument blade (b) Standardized position for the cutting edge of the instrument against the stone at all points on the curvilinear surface of the blade (c) no moving parts to wear out (d) no electrical apparatus, used chairside without alarming patient (e) completely sterilizable, enhanced patient safety (f) less expensive, easier to acquire for patient safety (g) conserves cutting edge, instruments last longer (h) immobilizes stone and instrument, sharper more effective cutting edge

DRAWING FIGURES

In the drawing, illustrative features only are labeled; similar mirror image features have the same function.

Reference Numerals in Drawings

10–15 rounded grooves to rest instrument handles establish correct angulation to stone

20 deep trench to stabilize sharpening stone placed lengthwise

30 depression in platform to accommodate curving shank of instruments

DESCRIPTION FIGS. 1 AND 2

The sharpening device will consist of a flat base or platform with a track for a stone of uniform size. Grooves will be placed at angles to the stone for placement of the instrument handles. The grooves will be placed corresponding to the angulation required to produce a cutting edge. Each groove will be labeled with the appropriate instrument or tool and the side of the blade to be sharpened.

The base may be made of plastic or metal and the track and grooves may be formed or machined in the material. A temperature resistant plastic to withstand repeated autoclaving or other means of sterilization can be used when manufactured for dental instruments. Material selection may vary depending upon application.

The design of the base may vary with application. The consistent feature will be the angled communication of the grooves to present the instrument or tool to the stone. For dental applications the size of the platform will be approximately 4' by 7" and ½" to ¾" thick to allow for handing and sterilizing. Other designs will vary for the instruments or tools sharpened.

Figure 1:
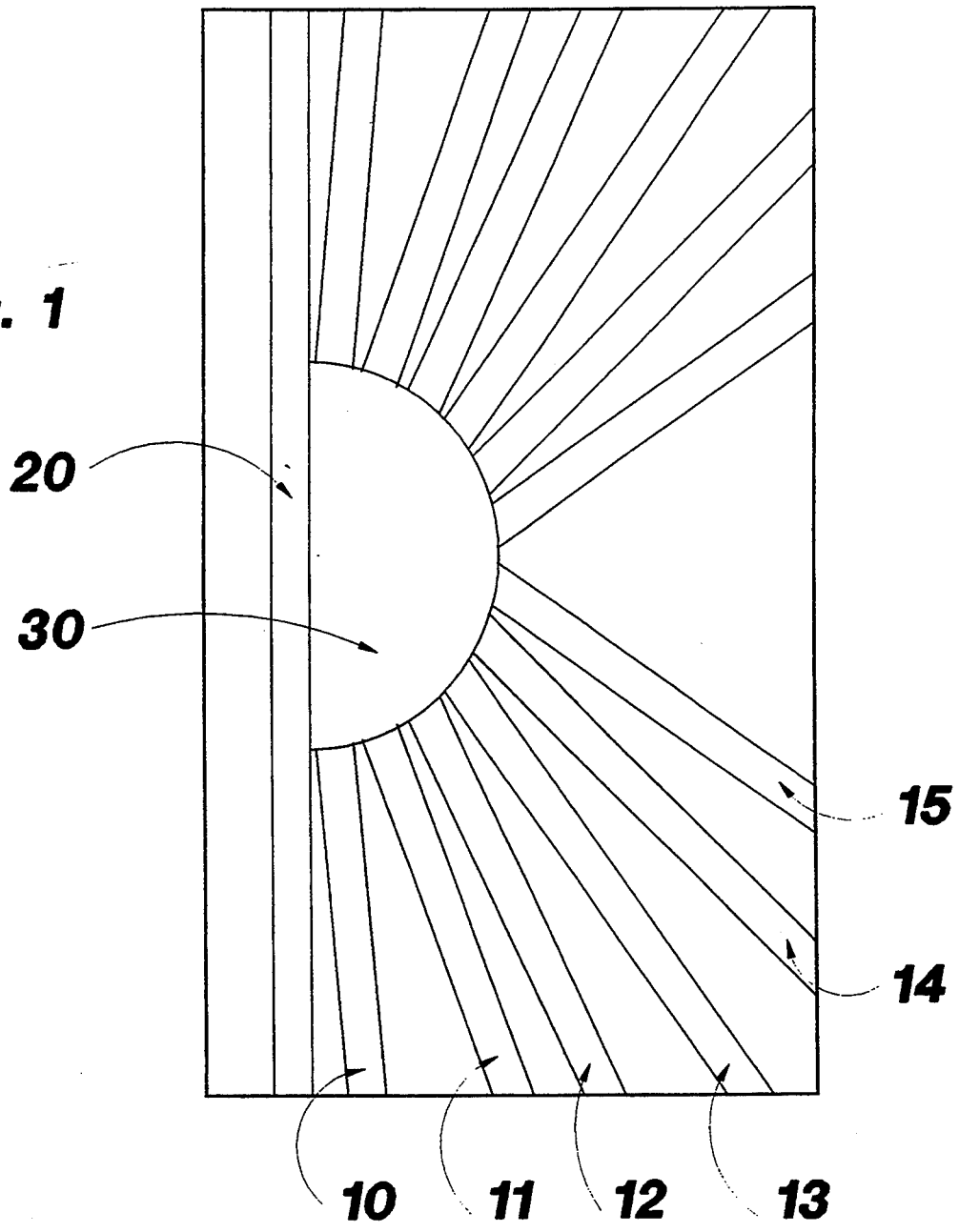
FIG. 1 illustrates the shape of the sharpening platform with trenches radiating at various angles for differing blade shapes.
Figure 2:
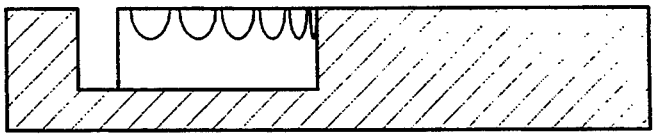
FIG. 2 illustrates a cross section of the platform at midpoint, dividing the two mirror image halves.

From the description, the advantages of this sharpening device become evident:

(a) manufacturing is simple (b) production materials are variable (c) the sharpener can be manufactured in sterilizable materials (d) the sharpening guide is simple to operate (e) the sharpening guide may be sterilized and thus discourage the cross contamination of communicable disease (f) ease of use will encourage sharpening and conserve the life of the instruments (g) freedom of use-not electrical- and economy will encourage effective use- less patient trauma with dental instruments Operation—FIGS. 1 and 2

The sharpener is used by placing a sharpening stone with dimensions of $\frac{1}{4}'' \times 1'' \times 4''$ in the trench. A lubricant may be applied to enhance movement and diminish blade abrasion.

The instrument to be sharpened is placed in the designated groove with the tip or toe of the blade facing up or away from the platform.

The blade is slid firmly against the stone and held with the fingers while the stone is moved gently back and forth with one inch oscillations with the other hand.

This may be repeated to remove additional blade surface, depending on the wear of the blade. As a last step, the blade may be rolled onto the stone to round the tip if required.

Dental instruments are generally used and sharped on the initial $\frac{1}{3}$ of the blade.

The sharpening guide is easy to use and clean with no electrical requirements. It may be used easily during procedures.

Summary, Ramifications, and Scope

The ease of use of this sharpener makes the effective maintenance of instruments and tools with a cutting edge simple and effective:

- a cutting edge may be reproduced and accurately maintained with he guide
- conservative and regular maintenance is possible, conserving instruments and tools
- parts may be sterilized, enhancing safety
- complex sharpening is easy, encouraging maintenance and reducing trauma and ineffective instrumentation
- sharpener maintenance is easy with no electrical requirements

**Although the description contains specifics, these should not be construed as limiting the scope of the invention, but merely as providing illustrations of some of the preferred embodiments of the invention. For example, the angle of the stone may change to accommodate other tools and the trench guide could be altered to use with woodworking tools as well as surgical applications.

Thus the scope of this inventions should be determined by the appended claims and their legal equivalents, rather than by the examples given.

I claim:

1. A dental instrument sharpner comprising a platform, said platform having a relative deep groove extending the length of said platform to accommodate a sharpening stone, said platform also bring provided with a relatively deep arcuately sharped recess communicating with said relatively deep groove to accommodate dental instruments, said platform also being provided with relatively shallow grooves radiating from said arcuately sharped recess to the edges of said platform for locating said dental instruments.

2. A dental instrument sharpener according to claim 1 wherein said relatively shallow grooves are rounded in cross section.

3. A dental instrument sharper according to claim 1 wherein said relatively deep arcuately sharped recess includes a curved wall encompassing approximately one hundred eighty degrees of curvature.

4. A dental instrument sharpener according to claim 1 wherein said platform is made of tempiture resistant plastic.

5. A dental instrument sharpener according to claim 1 wherein said platform in made from metal.

* * * * *